US007281398B1

(12) United States Patent
Sims

(10) Patent No.: US 7,281,398 B1
(45) Date of Patent: Oct. 16, 2007

(54) GOLF CLUB SECURING ASSEMBLY

(76) Inventor: Frederick B. Sims, 945 Linda Mar Blvd., Apt # 7, Pacifica, CA (US) 94044

( * ) Notice: Subject to any disclaimer, the term of this patent is extended or adjusted under 35 U.S.C. 154(b) by 130 days.

(21) Appl. No.: 11/297,055

(22) Filed: Dec. 9, 2005

(51) Int. Cl.
*E05B 73/00* (2006.01)
*A63B 55/04* (2006.01)

(52) U.S. Cl. ..... 70/58; 70/62; 70/64; 211/70.2; 206/315.6

(58) Field of Classification Search ..... 70/18, 70/57, 58, 59–62, 64; 211/4, 70.2; 206/315.2, 206/315.3, 315.6; 248/551–553; 280/DIG. 6; D3/318, 320
See application file for complete search history.

(56) References Cited

U.S. PATENT DOCUMENTS 4,686,529 A 8/1987 Kleefeldt
4,863,019 A * 9/1989 Lewis et al. ..... 206/315.3
D366,203 S 1/1996 Murphy
5,524,753 A * 6/1996 Murphy ..... 206/315.6
5,590,772 A * 1/1997 Schuhlen et al. ..... 206/315.3
5,610,585 A * 3/1997 Jobe ..... 340/568.6
5,636,735 A 6/1997 Stusek
5,918,490 A * 7/1999 Lion ..... 70/58
5,971,146 A * 10/1999 Jones ..... 206/315.3
6,006,904 A 12/1999 Jacobsen
6,050,405 A * 4/2000 Rossi et al. ..... 206/315.2
6,053,312 A 4/2000 Smith
6,062,050 A * 5/2000 Lion ..... 70/58
6,079,558 A * 6/2000 Yoon ..... 206/315.3
6,112,895 A 9/2000 Ryan
6,142,319 A * 11/2000 Kim ..... 211/70.2
6,196,385 B1 * 3/2001 Thompson et al. ..... 206/315.6
6,199,691 B1 * 3/2001 Wu ..... 206/315.6
6,244,438 B1 * 6/2001 Weinmeier ..... 206/315.6
6,381,998 B1 * 5/2002 Good ..... 70/58
7,025,202 B2 * 4/2006 Jansen et al. ..... 206/315.3
7,201,025 B2 * 4/2007 Mahre et al. ..... 70/18
7,219,464 B1 * 5/2007 Kujawa ..... 43/21.2

* cited by examiner

*Primary Examiner*—Lloyd A. Gall

(57) ABSTRACT

A golf club securing assembly includes a golf bag and an elongated support mounted therein. An elongated rod is mounted in and orientated parallel to a longitudinal axis of the support. The rod is slidable with respect to the support and is selectively positioned in a first position adjacent to a first end of the support or in a second position spaced from the first end of the support. Each of a plurality of couplers is configured to releasably secure a golf club adjacent to the support. Each of the couplers includes a first arm attached to the support and a second arm is attached to the rod. A driving assembly moves the first arms with respect to an associated one of the second arms into a closed position or an open position. The couplers may be used to secure a golf club to the support.

8 Claims, 5 Drawing Sheets

GOLF CLUB SECURING ASSEMBLY

BACKGROUND OF THE INVENTION

1. Field of the Invention

The present invention relates to golf club locking devices and more particularly pertains to a new golf club locking device for preventing unwanted removal of golf clubs from a golf bag.

2. Description of the Prior Art

The use of golf club locking devices is known in the prior art. U.S. Pat. No. 6,112,895 describes a device for securing golf clubs in a golf bag. Another type of golf club locking device is U.S. Pat. No. 6,053,312 having a golf bag having closable apertures therein for securing a golf club in the golf bag.

While these devices fulfill their respective, particular objectives and requirements, the need remains for a device that secures valuable clubs in a golf bag and which may be remotely controlled.

SUMMARY OF THE INVENTION

The present invention meets the needs presented above by comprising a golf bag that has a peripheral wall having an upper edge. The upper edge defines an opening extending into the golf bag. An elongated support has a first end and a second end. Each of the first and second ends is attached to an inner surface of the peripheral wall. The elongated support is positioned adjacent to the opening. An elongated rod is mounted in and orientated parallel to a longitudinal axis of the support. The rod is slidable with respect to the support and is selectively positioned in a first position adjacent to the first end of the support or in a second position spaced from the first end of the support. Each of a plurality of couplers is configured to releasably secure a golf club adjacent to the support. Each of the couplers includes a first arm and a second arm. Each of the first arms is attached to the support and each of the second arms is attached to the rod. The couplers are positioned in a closed position when corresponding ones of the first and second arms are moved toward each other. The couplers are placed in the closed position when the rod is moved to the second position and placed in an open position when the rod is moved to the first position. A driving assembly is mechanically coupled to the rod and is configured to selectively move the rod from the first position to the second position. A golf club may be secured to the support by one of the couplers when the couplers are placed in the locked position.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
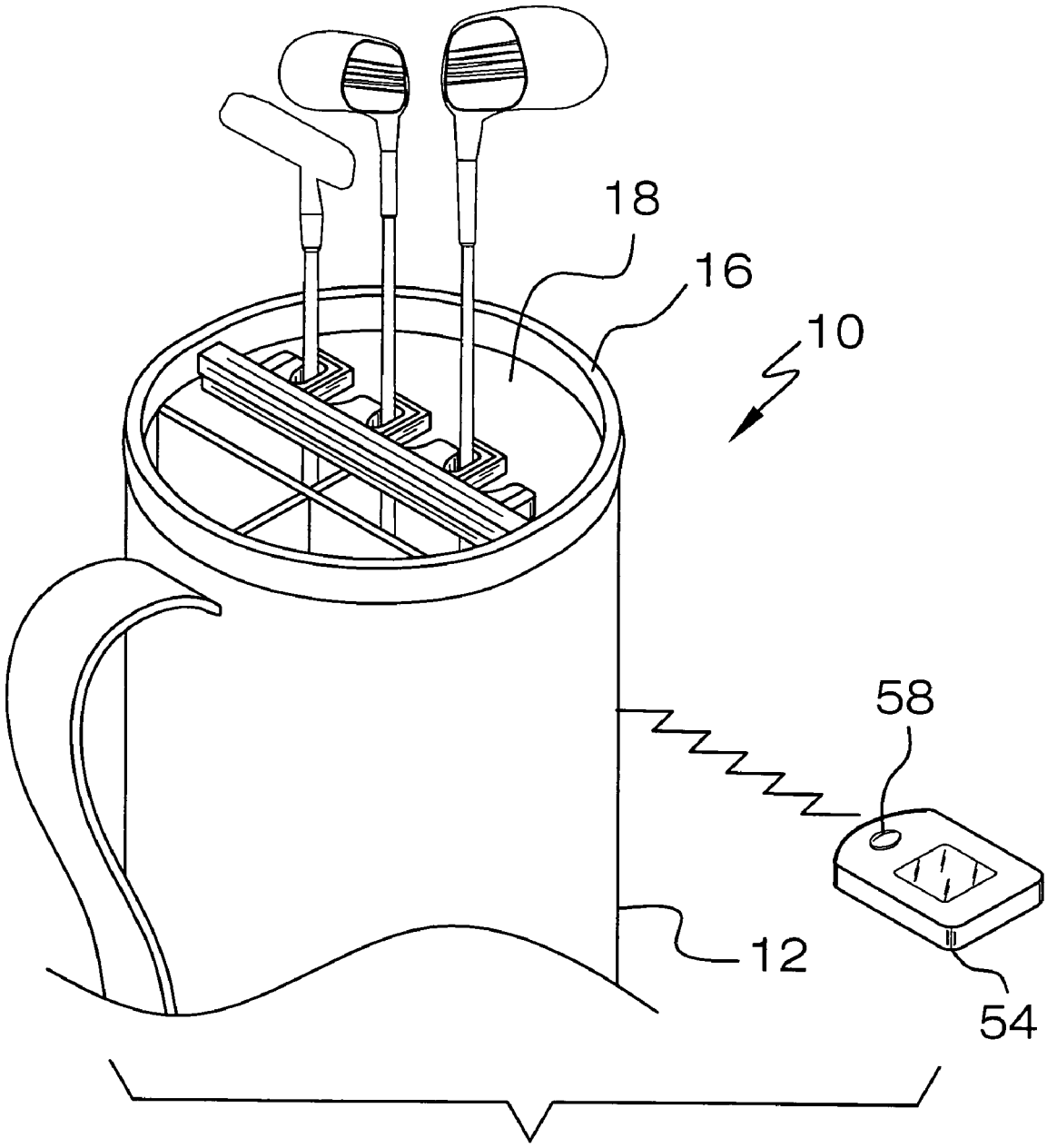
FIG. 1 is a perspective view of a golf club securing assembly according to the present invention.

With reference now to the drawings, and in particular to FIGS. 1 through 8 thereof, a new golf club locking device embodying the principles and concepts of the present invention and generally designated by the reference numeral 10 will be described.

As best illustrated in FIGS. 1 through 8, the golf club securing assembly 10 generally comprises a golf bag 12 that has a peripheral wall 14 having an upper edge 16. The upper edge 16 defines an opening 18 extending into the golf bag 12.

An elongated support 20 has a first end 21 and a second end 22. Each of the first 21 and second 22 ends is attached to an inner surface of the peripheral wall 14. The elongated support 20 is positioned adjacent to the opening 18. An elongated rod 24 is mounted in and orientated parallel to a longitudinal axis of the support 20. The rod 24 is slidable with respect to the support 20 and is selectively positioned in a first position adjacent to the first end 21 of the support or in a second position spaced from the first end 21 of the support 20.

A plurality of couplers 30 is provided. Each of the couplers 30 is configured for releasably securing a golf club 8 adjacent to the support 20. Each of the couplers 30 includes a first arm 31 and a second arm 32. The first arms 31 are attached to the support 20 and each of the second arms 32 is attached to the rod 24. The couplers 30 are positioned in a closed position when corresponding ones of the first 31 and second 32 arms are moved toward each other. This happens when the rod is moved to the second position 28. The couplers 30 are placed in an open position when the rod 24 is moved to the first position 26. Each of the second arms 32 has a bend 34 therein so that a free end 36 of each of the second arms 32 extends toward a corresponding one of the first arms 31. The first 31 and second 32 arms each have an inner surface 40 facing each other. Each of the inner surfaces 40 of the first arms 31 is curved. A resiliently compressible material 42 is attached to and covers each of the inner surfaces 40 of the second arms 32.

A driving assembly 44 is mechanically coupled to the rod 24 and is configured to selectively move the rod 24 from the first position 26 to the second position 28. The driving assembly 44 includes a solenoid 46 mechanically coupled to the rod 24 that is configured to move the rod 24 to the second position 28 when the solenoid 46 is turned on. A biasing member 48 is coupled to the rod 24 and biases the rod 24 to the first position. A receiver 50 is electrically coupled to the solenoid 46 and is configured to alternately turn the solenoid 46 on and off when the receiver 50 receives a wireless signal. A power supply 52, preferably one or more batteries, is electrically coupled to the receiver 50.

An actuating assembly 54 is configured to remotely actuate the driving assembly. The actuating assembly 54 includes a transmitter 56 operationally coupled to an actuator 58. The transmitter 56 sends the wireless signal to the receiver 50 when the actuator 58 is actuated.

Figure 2:
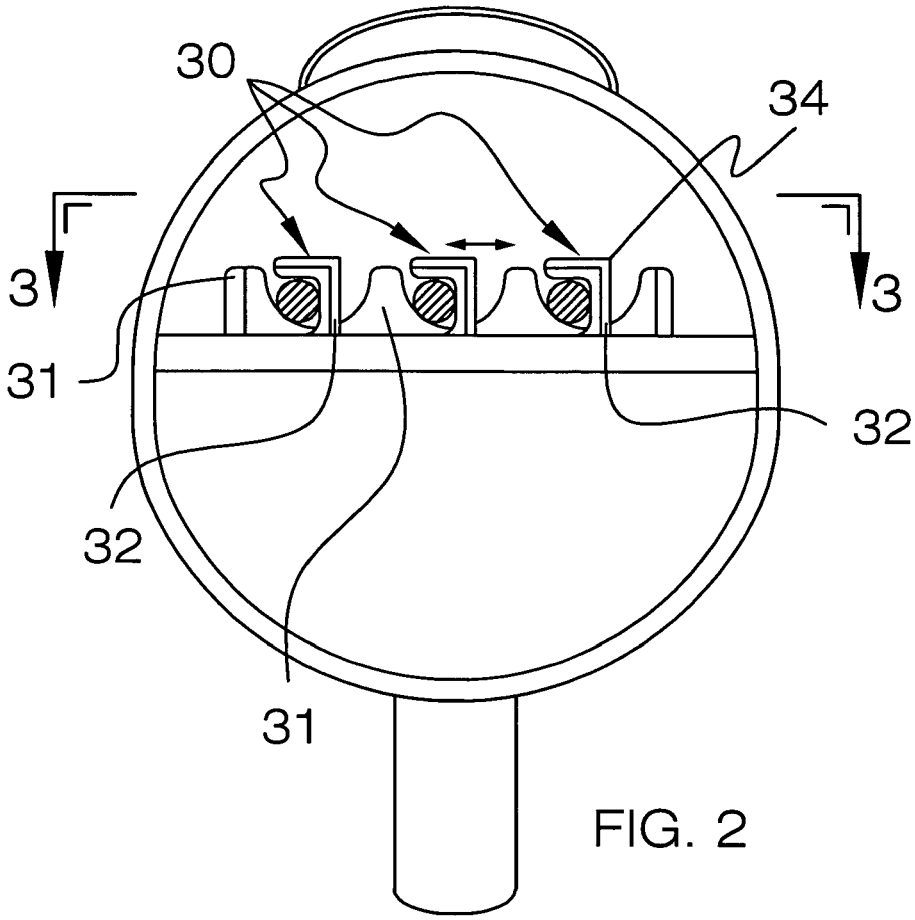
FIG. 2 is a top view of the present invention in a closed position.
Figure 3:
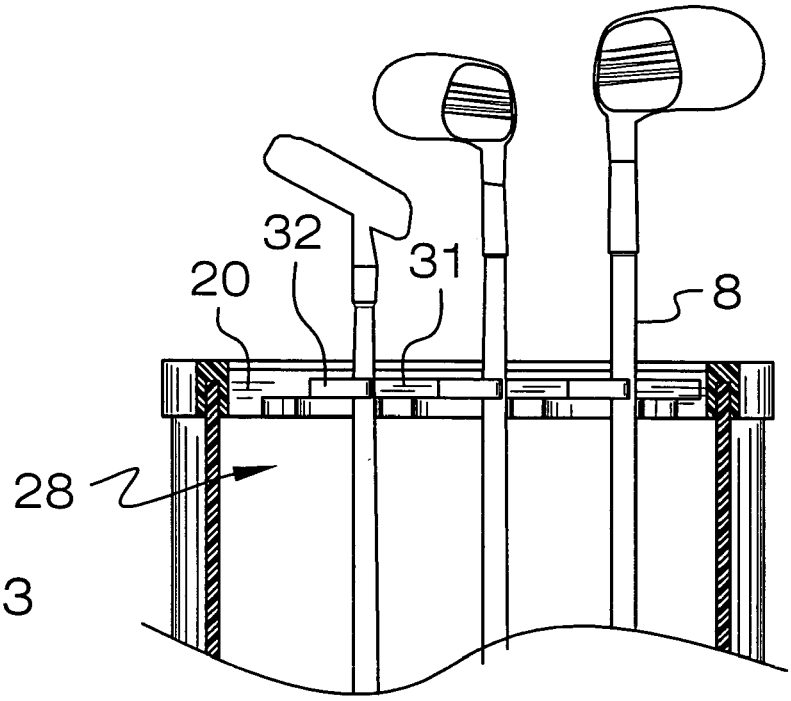
FIG. 3 is a cross-sectional view taken along line 3-3 of FIG. 2 of the present invention.
Figure 4:
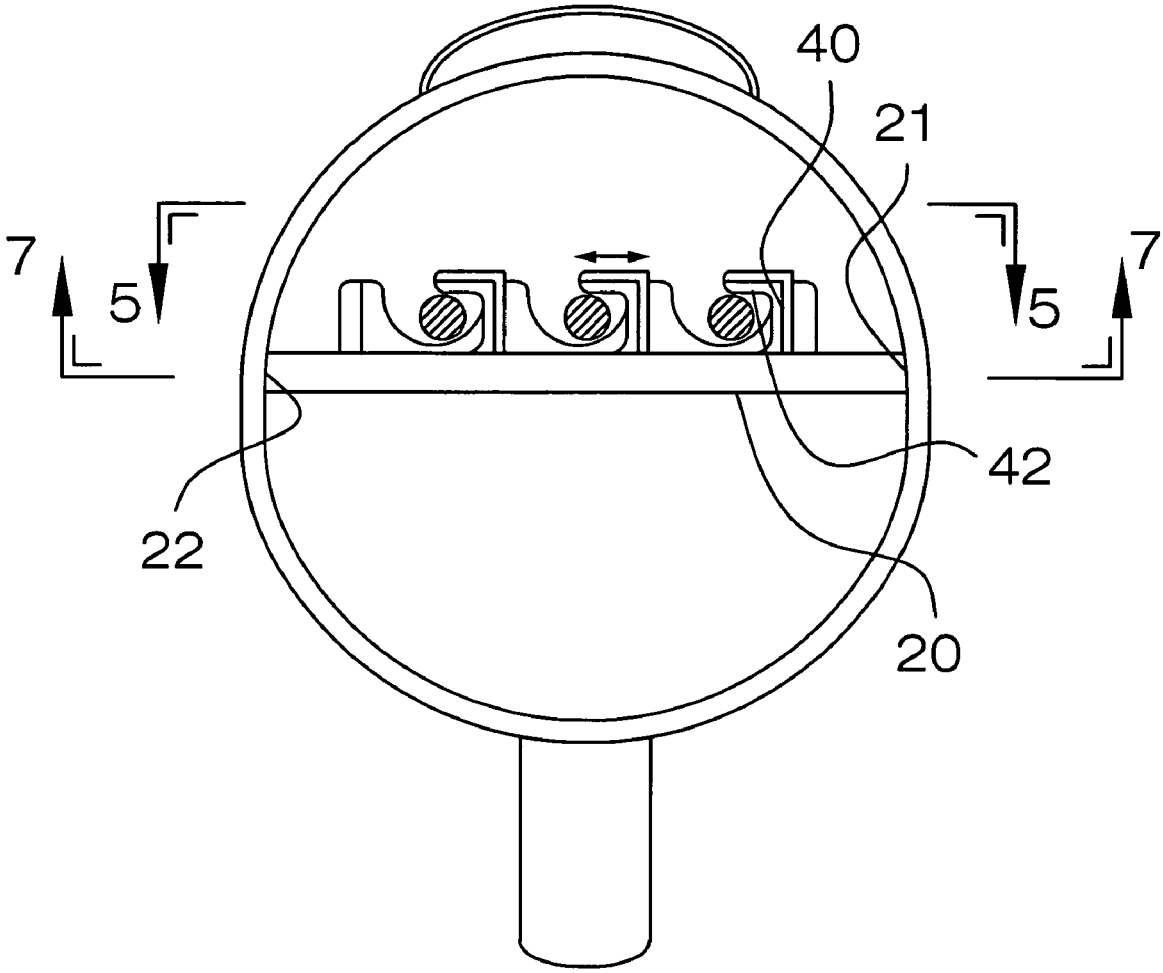
FIG. 4 is a top view of the present invention in an open position.
Figure 5:
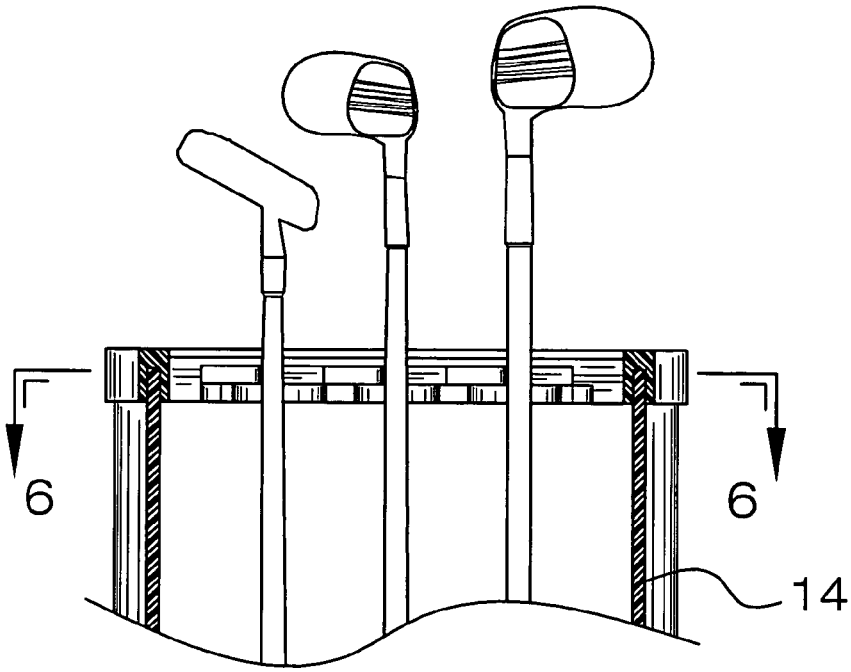
FIG. 5 is a cross-sectional view taken along line 5-5 of FIG. 4 of the present invention.
Figure 7:
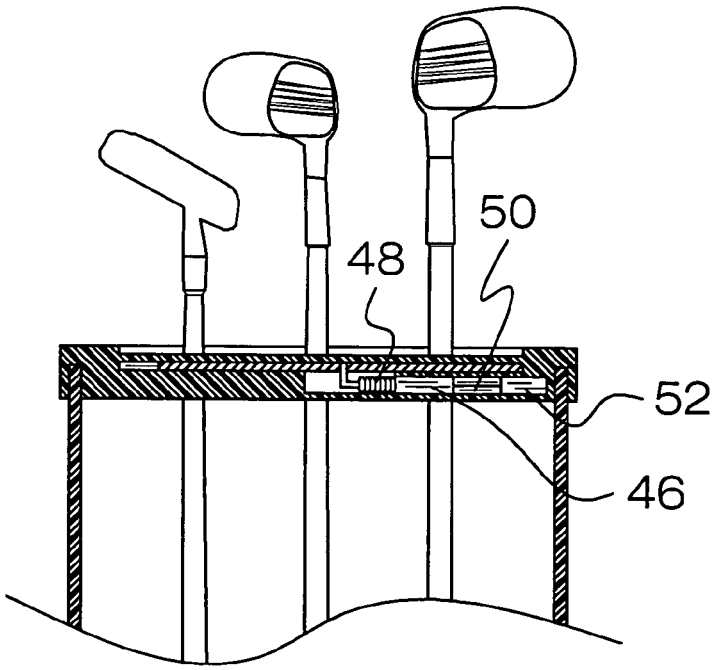
FIG. 7 is a cross-sectional view taken along line 7-7 of FIG. 4 of the present invention.
Figure 6:
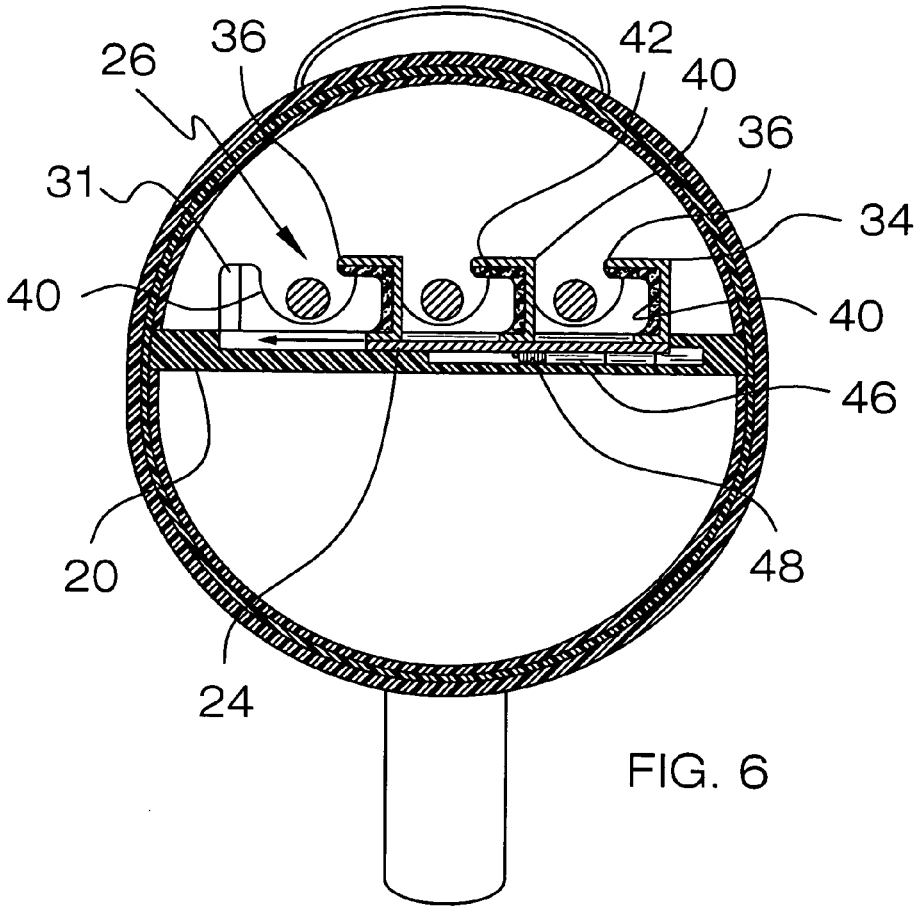
FIG. 6 is a cross-sectional view taken along line 6-6 of FIG. 5 of the present invention.
Figure 8:
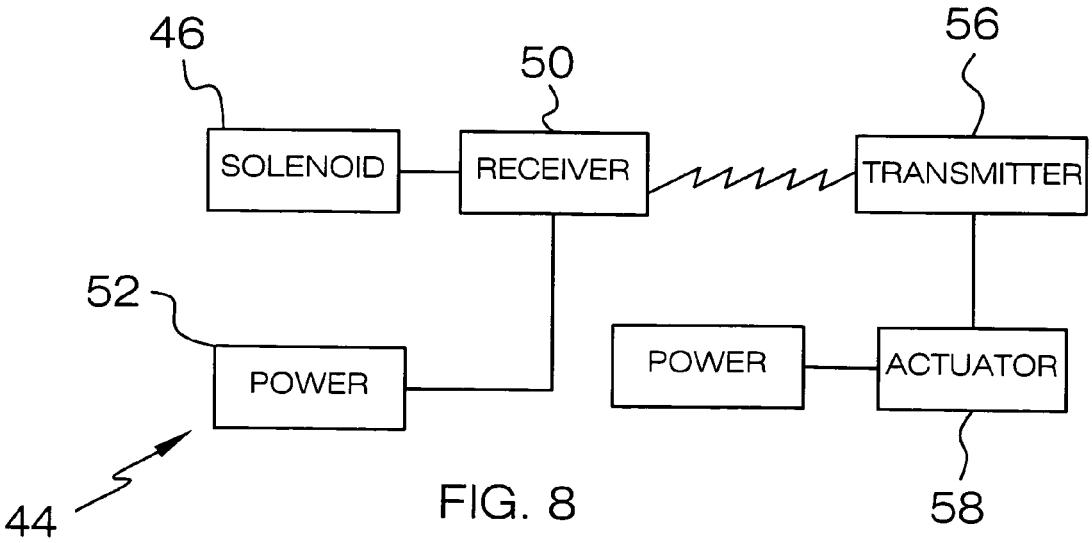
FIG. 8 is an electronic schematic view of the present invention.

In use, a golf club 8 may be secured to the support 20 by one of the couplers 30 when the couplers 30 are placed in the locked position as shown in FIG. 2. The couplers 30 may be opened to release the club or clubs 8 when they are to be used.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A golf club securing system, said system including:

a golf bag having a peripheral wall having an upper edge, said upper edge defining an opening extending into said golf bag;

an elongated support having a first end and a second end, each of said first and second ends being attached to an inner surface of said peripheral wall, said elongated support being positioned adjacent to the opening;

an elongated rod being mounted in and orientated parallel to a longitudinal axis of said support, said rod being slidable with respect to said support and being selectively positioned in a first position adjacent to said first end of said support or in a second position spaced from said first end of said support;

a plurality of couplers, each of said couplers being configured for releasably securing a golf club adjacent to said support, each of said couplers including a first arm and a second arm, each of said first arms being attached to said support, each of said second arms being attached to said rod, said couplers being positioned in a closed position when corresponding ones of said first and second arms are moved toward each other, said couplers being placed in said closed position when said rod is moved to said second position and placed in an open position when said rod is moved to said first position;

a driving assembly being mechanically coupled to said rod and being configured to selectively move said rod from said first position to said second position; and wherein a golf club may be secured to the support by one of said couplers when said couplers are placed in said closed position.

2. The system according to claim 1, wherein each of said second arms has a bend therein such that a free end of each of said second arms extends toward a corresponding one of said first arms.

3. The system according to claim 1, wherein each of said first and second arms each has an inner surface facing each other, each of said inner surfaces of said first arms being curved.

4. The system according to claim 3, further including a resiliently compressible material being attached to and covering each of said inner surfaces of said second arms.

5. The system according to claim 1, wherein said driving assembly includes a solenoid mechanically coupled to said rod and being configured to move said rod to said second position when said solenoid is turned on, a biasing member being coupled to said rod and biasing said rod to said first position.

6. The system according to claim 5, further including:

a receiver being electrically coupled to said solenoid and being configured to alternately turn said solenoid on and off when said receiver receives a wireless signal; and an actuating assembly being configured to remotely actuate said driving assembly, said actuating assembly including a transmitter operationally coupled to an actuator, said transmitter sending said wireless signal to said receiver when said actuator is actuated.

7. The system according to claim 1, further including an actuating assembly being configured to remotely actuate said driving assembly.

8. A golf club securing system, said system including:

a golf bag having a peripheral wall having an upper edge, said upper edge defining an opening extending into said golf bag;

an elongated support having a first end and a second end, each of said first and second ends being attached to an inner surface of said peripheral wall, said elongated support being positioned adjacent to the opening;

an elongated rod being mounted in and orientated parallel to a longitudinal axis of said support, said rod being slidable with respect to said support and being selectively positioned in a first position adjacent to said first end of said support or in a second position spaced from said first end of said support;

a plurality of couplers, each of said couplers being configured for releasably securing a golf club adjacent to said support, each of said couplers including a first arm and a second arm, each of said first arms being attached to said support, each of said second arms being attached to said rod, said couplers being positioned in a closed position when corresponding ones of said first and second arms are moved toward each other, said couplers being placed in said closed position when said rod is moved to said second position and placed in an open position when said rod is moved to said first position, each of said second arms having a bend therein such that a free end of each of said second arms extends toward a corresponding one of said first arms, said first and second arms each having an inner surface facing each other, each of said inner surfaces of said first arms being curved;

a resiliently compressible material being attached to and covering each of said inner surfaces of said second arms;

a driving assembly being mechanically coupled to said rod and being configured to selectively move said rod from said first position to said second position, said driving assembly including;

a solenoid mechanically coupled to said rod and being configured to move said rod to said second position when said solenoid is turned on;

a biasing member being coupled to said rod and biasing said rod to said first position;

a receiver being electrically coupled to said solenoid and being configured to alternately turn said solenoid on and off when said receiver receives a wireless signal;

an actuating assembly being configured to remotely actuate said driving assembly, said actuating assembly including a transmitter operationally coupled to an actuator, said transmitter sending said wireless signal to said receiver when said actuator is actuated; and wherein a golf club may be secured to the support by one of said couplers when said couplers are placed in said closed position.

* * * * *